United States Patent [19]

Neumann et al.

[11] Patent Number: 4,557,874

[45] Date of Patent: Dec. 10, 1985

[54] DISTRIBUTION SYSTEM FOR A TWO-PHASE FLUID MIXTURE

[75] Inventors: Joachim Neumann, Brunswick; Detlef Pickert; Klaus-Dieter Emmenthal, both of Wolfsburg, all of Fed. Rep. of Germany

[73] Assignee: Volkswagenwerk Aktiengesellschaft, Wolfsburg, Fed. Rep. of Germany

[21] Appl. No.: 613,101

[22] Filed: May 23, 1984

[30] Foreign Application Priority Data

Jun. 7, 1983 [DE] Fed. Rep. of Germany ..... 3320469

[51] Int. Cl.[4] ..... F02M 55/02

[52] U.S. Cl. ..... 261/19; 239/585; 137/561 A

[58] Field of Search ..... 123/445; 137/561 A; 239/585; 261/19

[56] References Cited

U.S. PATENT DOCUMENTS

| | | | |
|---|---|---|---|
| 3,262,466 | 7/1966 | Adams et al. | 137/561 A |
| 3,514,082 | 5/1970 | Haase | 123/445 |
| 3,795,259 | 3/1974 | Brandin et al. | 137/561 A |
| 3,864,938 | 2/1975 | Hayes, Jr. | 137/561 A |
| 4,126,058 | 11/1978 | Shelby et al. | 137/561 A |
| 4,392,612 | 7/1983 | Deckard et al. | 239/585 |

FOREIGN PATENT DOCUMENTS

| | | | |
|---|---|---|---|
| 2834844 | 3/1979 | Fed. Rep. of Germany . | |
| 2908095 | 9/1980 | Fed. Rep. of Germany . | |
| 3123261 | 12/1982 | Fed. Rep. of Germany . | |
| 2208646 | 8/1983 | Fed. Rep. of Germany | 123/445 |
| 57-200666 | 8/1982 | Japan | 123/445 |

*Primary Examiner*—Tim Miles

*Attorney, Agent, or Firm*—Brumbaugh, Graves, Donohue & Raymond

[57] ABSTRACT

In the particular distribution system described in the specification a first housing part has a fuel injection nozzle and an air inlet and the fuel-air mixture passes through a fluid supply line in the first housing part to a disc-shaped distribution chamber formed by a smooth surface on the first housing part and a closely spaced smooth surface on a second housing part which contains symmetrically disposed fluid discharge lines, the smooth surfaces being held in spaced relation by washers. Each discharge line has a bore which receives a hose and a hose-retaining device which urges the hose against the bottom of the bore.

10 Claims, 4 Drawing Figures

DISTRIBUTION SYSTEM FOR A TWO-PHASE FLUID MIXTURE

BACKGROUND OF THE INVENTION

This invention relates to systems for distributing a two-phase fluid such as a fuel-air mixture and, more particularly, to a new and improved two-phase fluid distribution system which assures uniform distribution in a simple and effective manner.

Two-phase fluid distribution systems for fuel-air mixtures are known, for example, from DE-OS No. 31 23 261. According to that publication, a discoid distribution chamber is provided with a cross section which is dimensioned in such a manner that the flow velocity of the fuel-air mixture entering the distribution chamber is exactly the same as the flow velocity in the feed line. This prevents separation of the two components of the mixture and ensure a uniform composition of the mixture as it is removed from the chamber through the discharge lines. Such devices are used, in particular, in fuel injection systems in which the fuel is metered into a carrier air current which is to be divided among the separate intake pipes for the several cylinders of an internal combustion engine. In such fuel injection systems at least one of the plane parallel surfaces forming the sides of the distribution chamber is within a cavity in one of the housing parts so as to provide a definite lateral boundary for the distribution chamber. This arrangement, however, results in the disadvantage that the chamber surface disposed within the cavity cannot be produced with sufficiently good surface quality since it cannot be ground. As a result, errors will occur in the distribution of the two phases of the two-phase fluid which are caused by the faulty surfaces.

SUMMARY OF THE INVENTION

It is an object of the present invention to provide a distribution system for a two-phase fluid which can be formed with surfaces of the highest possible surface quality so as to eliminate errors in distribution resulting from poor surface quality.

In accordance with the invention a disc-shaped distribution chamber includes smooth lateral surfaces formed in two housing parts which are held in spaced relation by interposition of one or more spacers which determine the size of the distribution chamber. With this arrangement the parallel surfaces of the chamber which are provided on the housing parts can be formed so as to achieve the best possible surface quality, for example, by grinding.

BRIEF DESCRIPTION OF THE DRAWINGS

Further advantages of the invention will be apparent from a reading of the following description in conjunction with the accompanying drawings, in which.

DESCRIPTION OF PREFERRED EMBODIMENTS

Figure 1:
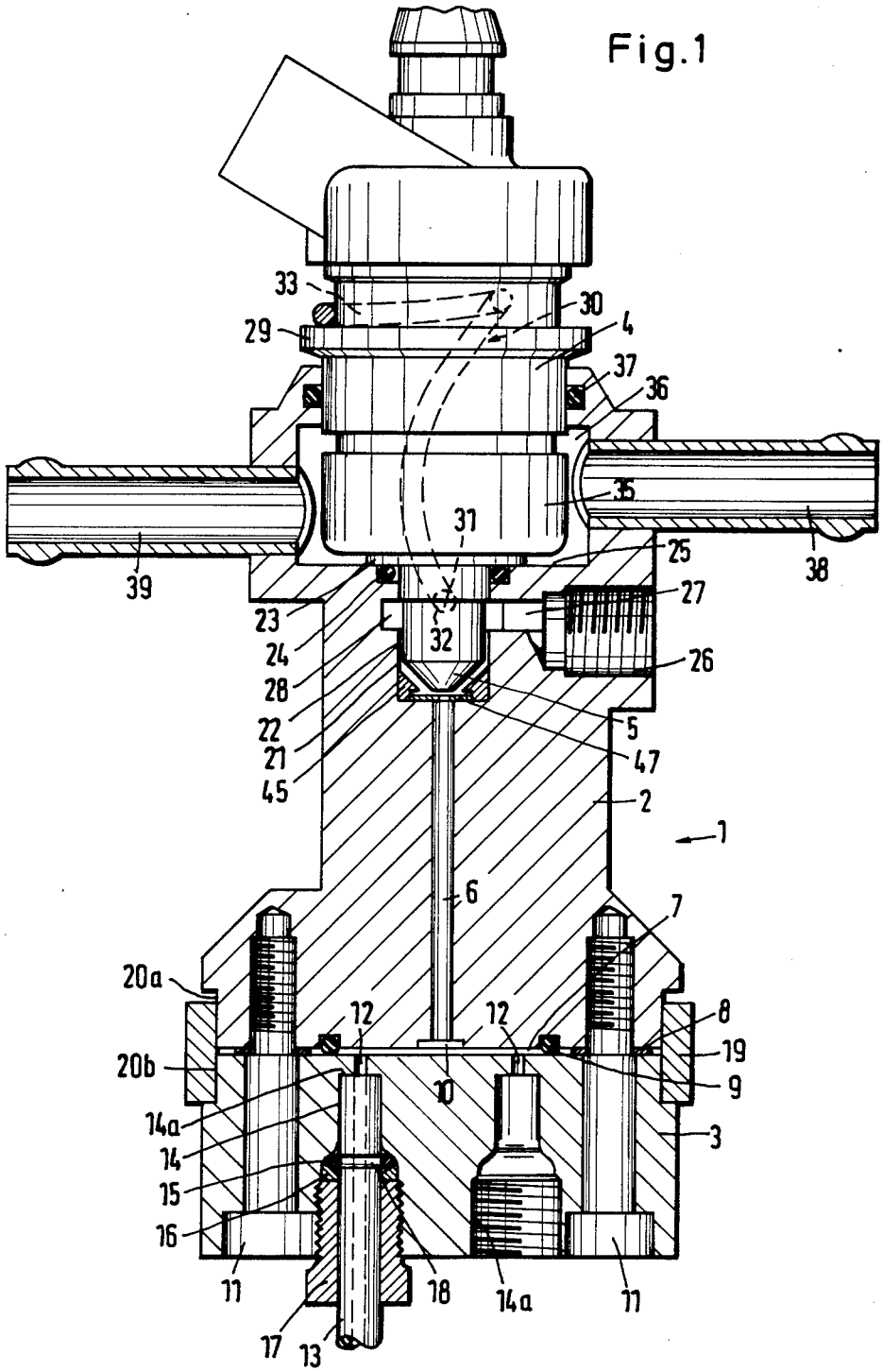
FIG. 1 is a cross-sectional view illustrating a representative two-phase fluid distribution system according to the invention.
Figure 2:
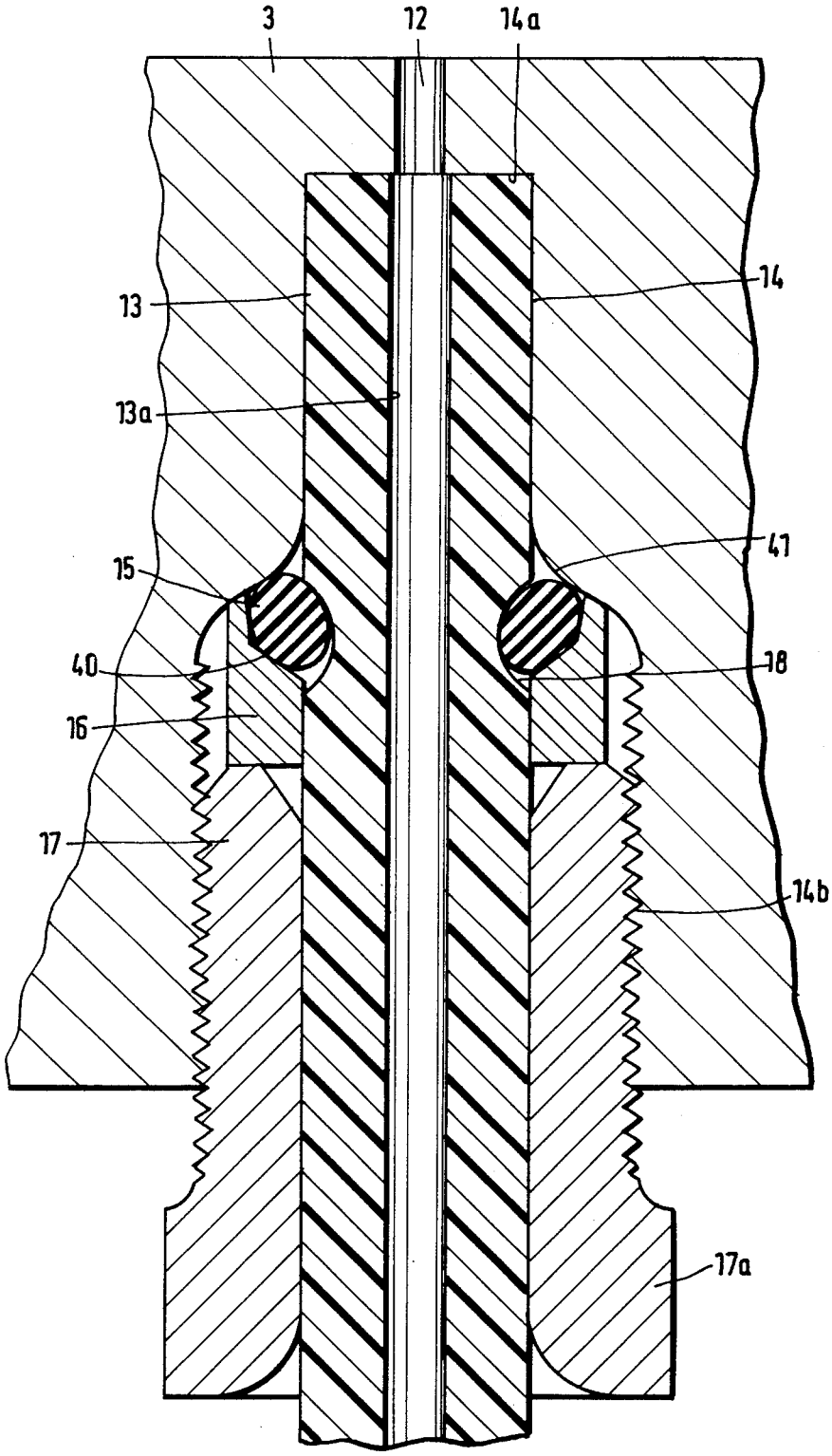
FIG. 2 is an enlarged sectional view illustrating a portion of the distribution system of FIG. 1, showing one form of fastening for the hose lines.
Figure 3:
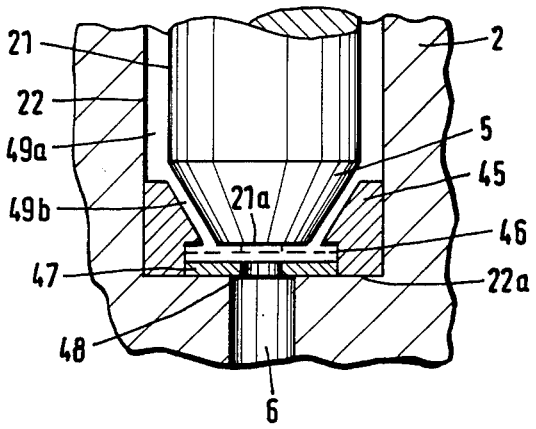
FIG. 3 is an enlarged sectional view illustrating another portion of the system of FIG. 1 showing the check valve arrangement below the injection nozzle.

In the typical embodiment of the invention shown in FIGS. 1–3, a distribution system 1 includes a first housing part 2 and a second housing part 3. A fuel injection device 4 has an injection nozzle 5 which injects fuel, comprising a liquid phase, into air, comprising a gaseous phase, so that a two-phase fluid mixture is produced which is to be distributed to a plurality of outgoing lines by means of the distribution system 1.

A feed line 6 for the two-phase mixture is arranged in the center of the first housing part 2 while a plurality of discharge lines 12, for example, four discharge lines, are arranged symmetrically with respect to the feed line 6 in the second housing part 3. Between the feed line 6 and the discharge lines 12 there is a disc-shaped distribution chamber 7 which is bounded by adjacent spaced faces of the housing parts 2 and 3 which are made smooth by grinding, for example. The height of the chamber 7 is determined by one or more washers 8 interposed between the parts 2 and 3. In the illustrated embodiment the washers surround each of a plurality of screws 11 which hold the housing parts together.

A sealing ring 9 is inserted between the parts 2 and 3 so as to surround the distribution chamber 7 and seal it from the outside. In addition, a small cylindrical cavity 10 is formed in the housing part 2 surrounding the opening of the feed line 6 into the distribution chamber 7. The cavity 10 assures a clean transition in the flow of the two-phase fluid from the feed line 6, which has a relatively small diameter, to the distribution chamber 7, which has a much larger diameter but is limited in height.

A centering ring 19, for centering the two housing parts 2 and 3, fits closely into two cylindrical recesses **20*a* and 20*b*, formed in the outer periphery of the two housing parts 2 and 3**, respectively. Instead of a centering ring, several fixing pins engaged in bores of the two housing parts could be provided to accomplish the same function.

To conduct the two-phase fluid which has been distributed among the individual discharge lines 12 to corresponding engine cylinders, for example, each discharge line leads to a bore 14 in the second housing part 3 in which a hose line 13 is releasably retained by friction. For this purpose, as shown in FIGS. 1 and 2, each hose line has a screw-cap or union bolt 17 which can be screwed into a threaded bore **14*b* in the second housing part 3. Each bolt 17 acts axially on a thrust ring 16 which deforms an O-ring 15 so as to produce frictional engagement and positive locking of the hose line 13 in the corresponding bore 14 of the second housing part 3. The O-ring 15 is compressed by the surfaces of an end-face cavity 40 in the thrust ring 16 against a transition contour 41 of the housing bore 14 and an annular groove 18** formed in the outer periphery of the hose line.

The annular groove 18, which has the shape of an arc in cross section is located slightly toward the outer end of the bore 14 with respect to the cavities 40 and 41 so that, when the O-ring 15 is compressed, an axial force is exerted on the hose line 13 to press it against the bottom **14*a* of the bore 14. In this manner a transition favorable to the flow of the two-phase fluid mixture is ensured from the discharge line 12, which is integral with the housing, to the hose line 13, having a slightly larger interior cross section 13***a*. Moreover, the attachment of the hose line 13 to the second housing part 3 by an axially compressed O-ring 15 which is positively engaged in the annular groove 18, as shown in FIG. 2, assures that the flow cross section 13*a* of the hose line 13 is not impaired.

Figure 4:
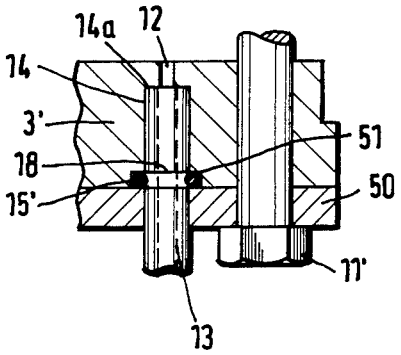
FIG. 4 is a fragmentary sectional view illustrating an alternative arrangement for fastening the hose lines in the fluid distribution system of the invention.

FIG. 4 illustrates an alternative arrangement for attaching the hose line 13 to the second housing part. In this arrangement an end plate 50 for the housing part is provided in place of the cap screws 17, the end plate 50 acting axially on an O-ring 15' surrounding each hose line 3. The end plate 50 is retained, along with the housing part 3', by screws 11' to the housing part 2 and thereby compresses the O-ring 15' surrounding each hose line 13 in a corresponding cavity 51 in the second housing part 3'. In this case, as in the embodiment of FIGS. 1–3, the hose line 13 has an arc-shaped annular groove 18 which is axially offset relative to the cavity 51 so that the O-ring applies an axial force urging the hose line 13 against the bottom 14*a* of the bore.

As shown in FIGS. 1 and 3, the first housing part 2 has a cylindrical bore 22 into which the injection device 4 projects. The injection device 4 is detachably fastened to the housing part 2 by a spring wire strap 30 having two ends 31 engaged in diametrically opposite bores 32 in the outer shell of the housing part 2. An approximately semicircular arc 33 at the center of the spring wire strap 30 engages a circumferential web 29 on the injection device 4 so that the spring force of the spring wire strap 30 urges the injection device against the first housing part 2. As a result, an annular collar 23 on the injection device 4 is pressed against an inner housing end face 25 so that the axial position of the injection nozzle 5 in the housing part 2 is fixed. The bore 22 which receives the injection nozzle is sealed from the outside by a ring seal 24. The bottom part 5 of the injection nozzle has an outer diameter 21 which is spaced from the bore 22, providing an annular passage 49*a* for air as the gaseous phase which is received through a radial opening 27 into the annular groove 28. The opening 27 has a threaded bore 26 by which a connecting line delivering the gaseous phase may be attached to the housing part 2.

As best seen in FIG. 3, a check valve in form of an annular plate 47 is inserted between the injection nozzle 5 and the feed line 6. The annular plate 47 is held in a cylindrical cavity 46 of a ring insert 45 which, in turn, is mounted in the housing bore 22, and the plate 47 has an aperture 48 which must be larger in cross-sectional area than the discharge opening of the injection nozzle 5. The check valve is arranged to prevent return flow, especially of the liquid phase, into the annular space 49*a* between the outer shell 21 of the injection nozzle 5 and the bore 22. This is accomplished because the annular plate 47, which normally rests on the bottom 22*a* of the bore 22, as shown in full lines in FIG. 3, has an aperture 48 which is smaller than the feed line 6 so that a reverse flow will automatically press the plate 27 against the end face 21*a* of the injection nozzle 5. In the latter position, indicated by broken lines in FIG. 3, the annular plate 47 closes off access to the annular space 49*b* surrounding the conical end of the injection nozzle 5 which is in communication with the annular space 49*a*. In this manner a reverse flow of the liquid phase is avoided, thereby preventing the fuel-air mixture from becoming leaner.

The fuel injection device 4 has an electromagnet 35, shown in FIG. 1, which is greatly stressed and accordingly becomes heated during operation. In order to cool the electromagnet 35, a cylindrical chamber 36 is formed in the housing part 2 around the magnet 35, the chamber 36 being sealed from the outside by an annular seal 37. A coolant, such as the excess fuel not needed by the injection device 4, is directed into the annular space 36 through a delivery line 38 and is withdrawn from the annular space 36 through a second line 39. In this manner, the liquid phase not needed by the injection device, in this case the fuel not required for the fuel-air mixture, is utilized for cooling the electromagnet 35 of the injection device 4, prior to being returned to the tank, so that the injection device can operate properly even when it is subjected to great stress.

We claim:

1. A distribution system for a two-phase fluid mixture comprising a first housing part having a completely plane, smooth end surface and formed with a single fluid supply line leading to the smooth surface, a second housing part having a completely plane, smooth end surface positioned in spaced parallel relation to the smooth end surface of the first housing part and formed with a plurality of fluid discharge lines leading from the smooth end surface and disposed symmetrically with respect to the fluid supply line, and spacer means engaging the smooth end surfaces of the first and second housing parts to hold them in spaced parallel relation to provide a disc-shaped fluid distribution chamber therebetween for distributing fluid from said fluid supply line to said fluid discharge lines, whereby the size of the distribution chamber is determined by the size of the spacer means.

2. A distribution system according to claim 1 including a plurality of hose lines connected to corresponding bores communicating with the fluid discharge lines in the second housing part.

3. A distribution system for a two-phase fluid mixture comprising a first housing part having a smooth surface and formed with fluid supply line leading to the smooth surface, a second housing part having a smooth surface positioned in spaced parallel relation to the smooth surface of the first housing part and formed with a plurality of fluid discharge lines leading from the smooth surface and disposed symmetrically with respect to the fluid supply line, spacer means engaging the smooth surfaces of the first and second housing parts to hold them in spaced parallel relation to provide a disc-shaped fluid distribution chamber between the smooth surfaces of the housing parts whereby the size of the distribution chamber is determined by the size of the spacer means, and a plurality of hose lines connected to corresponding bores communicating with the fluid discharge lines in the second housing part, the hose lines being received in the bores and including retaining means for holding the hoses in the bores and urging the ends of the hoses against the bottom surfaces of the bores.

4. A distribution system according to claim 3 wherein the retaining means includes an elastically deformable sealing ring surrounding each hose line and a corresponding cavity in the second housing part, the sealing ring being axially compressed between the hose line and a wall of the cavity.

5. A distribution system according to claim 4 wherein each line is formed with a circumferential ring groove in its exterior surface in which the sealing ring is compressed.

6. A distribution system according to claim 5 wherein the ring groove is slightly offset axially with respect to the cavity in the second housing part so that when the sealing ring is compressed an axial force is exerted on the ring groove to urge the hose line against the bottom surface of the bore.

7. A distribution system according to any of claims 1 through 6 including an injection nozzle for supplying liquid to the fluid supply line in the first housing part and a check valve downstream from the injection nozzle.

8. A distribution system according to claim 7 wherein the check valve comprises a thin annular plate supported for axial motion adjacent to the injection nozzle and responsive to reverse flow of fluid in the fluid supply line to move against the end face of the injection nozzle.

9. A distribution system according to any of claims 1 through 6 including an injection device for delivering the liquid phase to the first housing part and a spring wire strap for detachably holding the injection device on the first housing part.

10. A distribution system according to any of claims 1 through 6 wherein the first housing part has an injection device with an electromagnet and wherein the first housing part has a chamber surrounding the electromagnet, and including means for passing liquid not required by the injection device through the chamber surrounding the electromagnet.

* * * * *